US005357875A

United States Patent [19]

Winebarger et al.

[11] Patent Number: 5,357,875

[45] Date of Patent: Oct. 25, 1994

[54] CORRUGATED PALLET

[75] Inventors: Ken N. Winebarger, Lakeland, Fla.; Stanley M. Lee, Tomball, Tex.

[73] Assignee: Corrugated Pallet Corporation, Lakeland, Fla.

[21] Appl. No.: 40,338

[22] Filed: Mar. 30, 1993

Related U.S. Application Data

[63] Continuation of Ser. No. 792,182, Nov. 14, 1991, Pat. No. 5,218,913, which is a continuation-in-part of Ser. No. 631,714, Dec. 21, 1990, abandoned, which is a continuation of Ser. No. 321,022, Mar. 9, 1989, Pat. No. 4,979,446.

[51] Int. Cl.[5] ..... B65D 19/00

[52] U.S. Cl. ..... 108/51.3

[58] Field of Search ..... 108/51.3, 51.1, 56.1, 108/56.3

[56] References Cited

U.S. PATENT DOCUMENTS

| | | | |
|---|---|---|---|
| 2,494,730 | 1/1950 | Thursby | 108/51.3 X |
| 2,709,559 | 5/1955 | Geisler | 108/51.3 |
| 2,728,545 | 12/1955 | Hermitage | 108/51.3 |
| 3,464,371 | 9/1969 | Gifford | 108/51.3 |
| 4,792,325 | 12/1988 | Schmidtke | 108/51.3 X |
| 4,867,074 | 9/1989 | Quasnick | 108/51.3 |
| 5,184,558 | 2/1993 | Wozniacki | 108/51.3 |

*Primary Examiner*—Jose V. Chen

*Attorney, Agent, or Firm*—Marshall & Melhorn

[57] ABSTRACT

A pallet of corrugated fiberboard material has floor-contacting spaced, parallel and longitudinal extending base members perpendicularly interconnected at longitudinally spaced intervals by spaced, parallel and laterally extending deck members. Each member is constructed from creased and scored rectangular blanks folded to comprise a solid core of adjacent vertically oriented panels surrounded by an outer covering of perimetric horizontally and vertically running panels.

16 Claims, 8 Drawing Sheets

CORRUGATED PALLET

This application is a continuation of U.S. patent application Ser. No. 07/792,182, filed Nov. 14, 1991 (Now U.S. Pat. No. 5,218,913), which is a continuation-in-part of U.S. patent application Ser. No. 07/631,714, filed Dec. 21, 1990 (now abandoned), which is a continuation of U.S. patent application Ser. No. 07/321,022, filed Mar. 9, 1989 (now U.S. Pat. No. 4,979,446).

BACKGROUND OF THE INVENTION

This invention relates in general to a pallet of corrugated material; and, more specifically, to a corrugated pallet having superior strength and break resistance.

Pallets are widely used in the transportation and storage of goods. The goods (typically packaged in boxes or bags) are stacked on the pallet and bound thereto by straps or wrapping for shipment therewith as an integral unit. Loaded pallets are stored in warehouses either on the floor or in racks in adjacent single or multiple level layers.

Conventional pallets are usually made of wood. Wooden pallets offer good materials handling and stacking strength characteristics. The decreasing supply of readily available wood is raising the cost of such pallets, however, and such wooden pallets are heavy and bulky to transport.

The use of pallets made of corrugated paperboard and similar materials as a substitute for wooden pallets has gained limited acceptance for some applications. Such corrugated pallets are lightweight, relatively maintenance free and readily disposable or recyclable. They may be transported and stored in unassembled form for maximum space utilization when unloaded, and assembled on-site for loading. After usage, they can be broken down for disposal or recycling just like cardboard boxes and other corrugated products.

One kind of known corrugated pallet is illustrated by the structures shown in U.S. Pat. Nos. 2,466,914; 2,728,545; 3,464,371; and 3,477,395. Such pallets comprise a plurality of longitudinally extending elongated base members or stringers held in parallel, spaced relation by means of top and bottom rectangular decking sheets to form skids with open channels into which the tines of forklifts can be inserted for materials handling purposes. Other versions of such pallets, as shown in U.S. Pat. Nos. 3,131,856 and 3,683,822, add a degree of lateral stability by providing a plurality of laterally extending, parallel, spaced deck members or cross runners perpendicularly interconnecting the base members at axially spaced intervals to form a rectangular lattice structure. The deck members span the base members in elevated positions without floor contact between the base members leaving the fork channels unobstructed.

Though known corrugated pallets provide lightweight, inexpensive alternatives to conventional wooden pallets for some applications, their strength and rigidity under both static and dynamic loading is insufficient to permit widespread general usage for all types and distributions of goods. Base member constructions, such as shown in the '371 and '395 patents having wrapped, adjacent side-by-side thicknesses of fluted fiberboard material placed in vertical direction of corrugation, are not know to have been employed in criss-cross lattice type pallet structures such as shown in the '656 and '822 patents. Rather, the latter type corrugated pallets having perpendicularly interconnecting base and deck members have generally been formed from weak, relatively open core, support members. The skid type structures have no lateral support members at all; and the lateral members of the lattice type structures do not contact the floor between longitudinal members, so provide only suspension lateral weight supporting capabilities. Structures, such as the lattice shown in the '822 patent, are moreover prone to rocking instability, with the elevated cross ties being able to pivot out of the base members under dynamic loading.

No known self-supporting pallet structures make adequate accommodation for four-way forklift tine entry into the pallet. The skid types represented by the '914, '545, '371 and '395 pallets, provide only two-way, front and rear entry into the spaces between the base members formed by the top and bottom sheets. The lattice types represented by the '656 and '822 patents provide the same two-way entry between the base members in the area below the deck members and, in addition, provide optional four-way access by means of cutouts or "pockets" made at floor level in the deck member (see, e.g., the pallets of Corpal Systems, Inc., Jacksonville, Fla.). Four-way entry is also provided in related but contained non-freestanding structures, such as shown in the U.S. Pat. No. 3,666,165. However, such inherently weak, open core member structures lack strength at critical points and are subject to ripping at cuts made for fork tine insertion if the carried goods exceed the weight of cushions, textiles and similar light loads.

The strongest known corrugated pallets today have a load rating for a 4'×4' pallet of only 6,000–8,000 pounds under static loading. Such figures are only for careful uniform stacking of concrete blocks, however, and only for two-way addressable pallets. Under actual road transportation and warehouse stacking conditions, the strength of such pallets is considerably less. And, adding cutouts for four-way fork tine entry reduces the maximum strength load-carrying capability further.

SUMMARY OF THE INVENTION

It is an object of the present invention to provide a corrugated pallet having superior strength and break resistance under both static and dynamic loading.

In one aspect of the invention, a pallet is provided having a plurality of spaced parallel and longitudinally extending base members interconnected by a plurality of spaced parallel and laterally extending, floor contacting deck members to form a superior weight-supporting, freestanding lattice structure. In another aspect of the invention, a pallet is provided giving two- or four-way fork tine access through strengthened floor contacting members having cutouts backed up by unbroken elevated portions of the same. In a further aspect of the invention, a pallet is provided as an inexpensive skid having interlocking base and deck members of similar construction, the base members being oriented vertically and the deck members horizontally.

In a preferred embodiment, described in detail below, a corrugated pallet is formed from base and deck members each having a solid core of adjacent vertically oriented panels surrounded by an unbroken outer cover of perimetrically running panels. Each member is formed from a single, rectangular blank of corrugated material divided into adjacent rectangular panels which are folded along crease and score lines laid perpendicular to the direction of corrugation. Tests conducted using concrete blocks have shown that a pallet in accordance with the invention is approximately three to four times stronger than same sized corrugated pallets such as those disclosed in U.S. Pat. No. 3,683,822. The members are configured to provide tine admitting openings and unbroken horizontal panel surfaces in alignment with horizontally disposed tops of the openings. The resulting structure provides good weight-supporting and materials handling capabilities with tested weight stacking capability and break resistance approaching that of pallets made from soft wood.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DESCRIPTION OF THE PREFERRED EMBODIMENTS

Figures 1, 3:
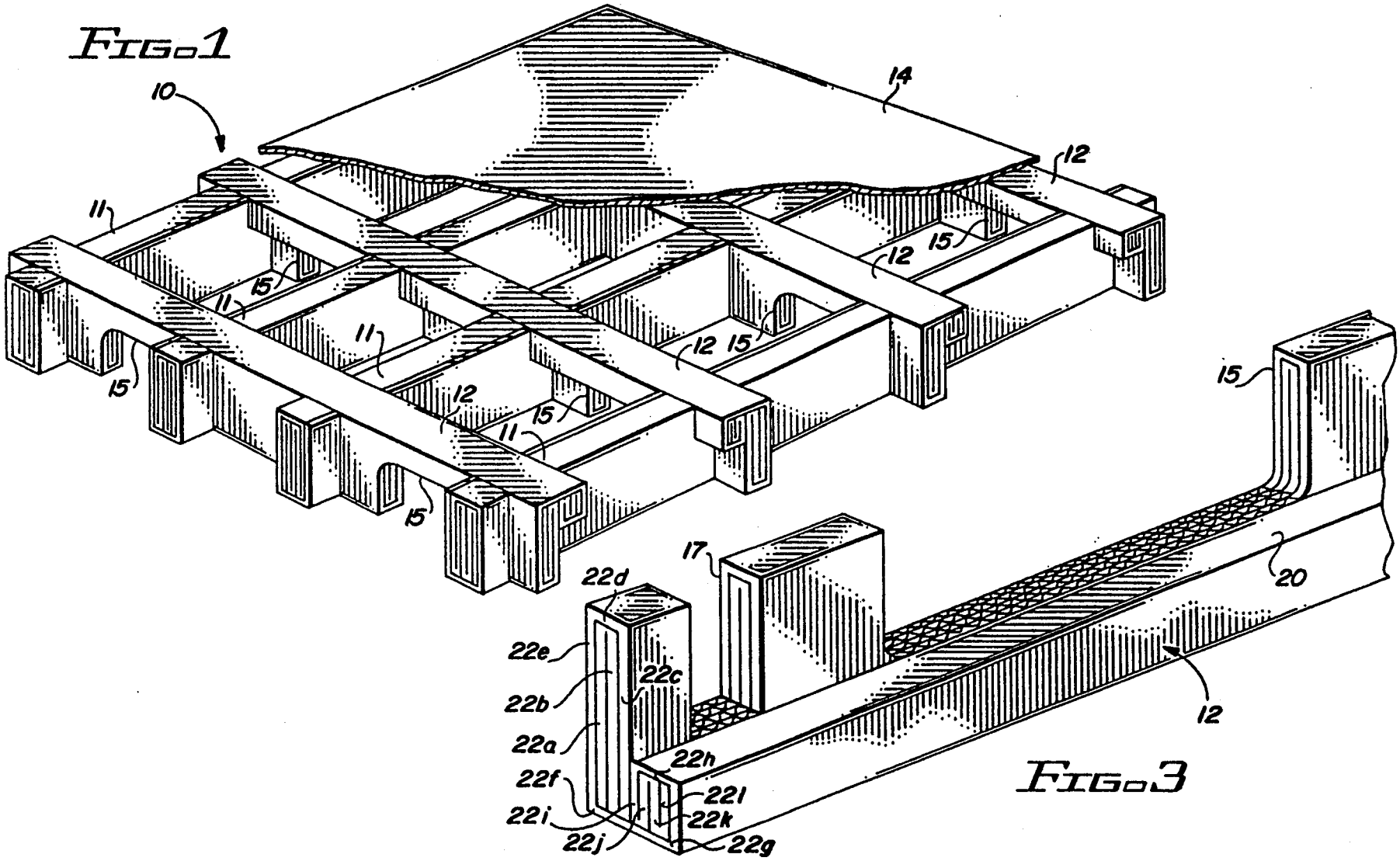
FIG 1 is a perspective view, partially cut away, of a corrugated pallet in accordance with the present invention.
FIG. 3 is a perspective view showing the underside of the deck member of FIG. 2.

As shown in FIG. 1, an embodiment 10 of a pallet in accordance with the present invention comprises a plurality of elongated base members or stringers 11 laid in parallel, spaced positions longitudinally of the pallet 10 and interconnected in criss-cross fashion to form a free-standing weight-supporting lattice structure by a plurality of elongated deck members or cross runners 12 laid in parallel, spaced positions laterally of the pallet 10 to respectively perpendicularly intersect the members 11 at axially displaced positions therealong. The shown embodiment 10 utilizes four base members 11 and four decking members 12, though it is, of course, possible to utilize a fewer or greater number of such members, if desired.

The top surfaces of the members 11 and 12 are located in a common horizontal plane to provide a level upper platform for stacking goods (not shown) thereon. An optional top sheet or deck 14 (shown in cutaway) may be applied to the top surfaces to cover the interstices of the underlying lattice framework. The bottom surfaces of the members 11 and 12 are likewise coplanar to provide a stable, floor-contacting base for the pallet 10. The lateral members 12 are each provided with aligned cutouts 15 to provide longitudinal channels between the floor and the pallet structure 10 for two-way (front or rear) access thereinto for pallet lifting purposes by the tines of a forklift or like materials handling apparatus.

The members 11 and 12 and the top sheet 14 are all constructed of corrugated paperboard, plastic, or similar material. As shown in FIGS. 2–5, each member has a solid core of adjacent vertically stacked rectangular panels oriented with their corrugations running vertically and an outer covering or sheath of perimetrically placed rectangular panels of the same material alternately running horizontally and vertically around the core panels. The members 11 and 12 are unbroken except at their points of intersection and at the forklift tine cutouts 15.

The members 11 and 12 are interconnected at their points of intersection by locking and linking joints, in which a protuberance or void of one member mates in close tolerance relationship with a complementary protuberance or void of an intersected member. The joints should impart sufficient rigidity to the intersection to maintain a fixed relationship between them under longitudinal, lateral and axial rotational forces to be experienced during normal loaded pallet handling.

Figure 2:
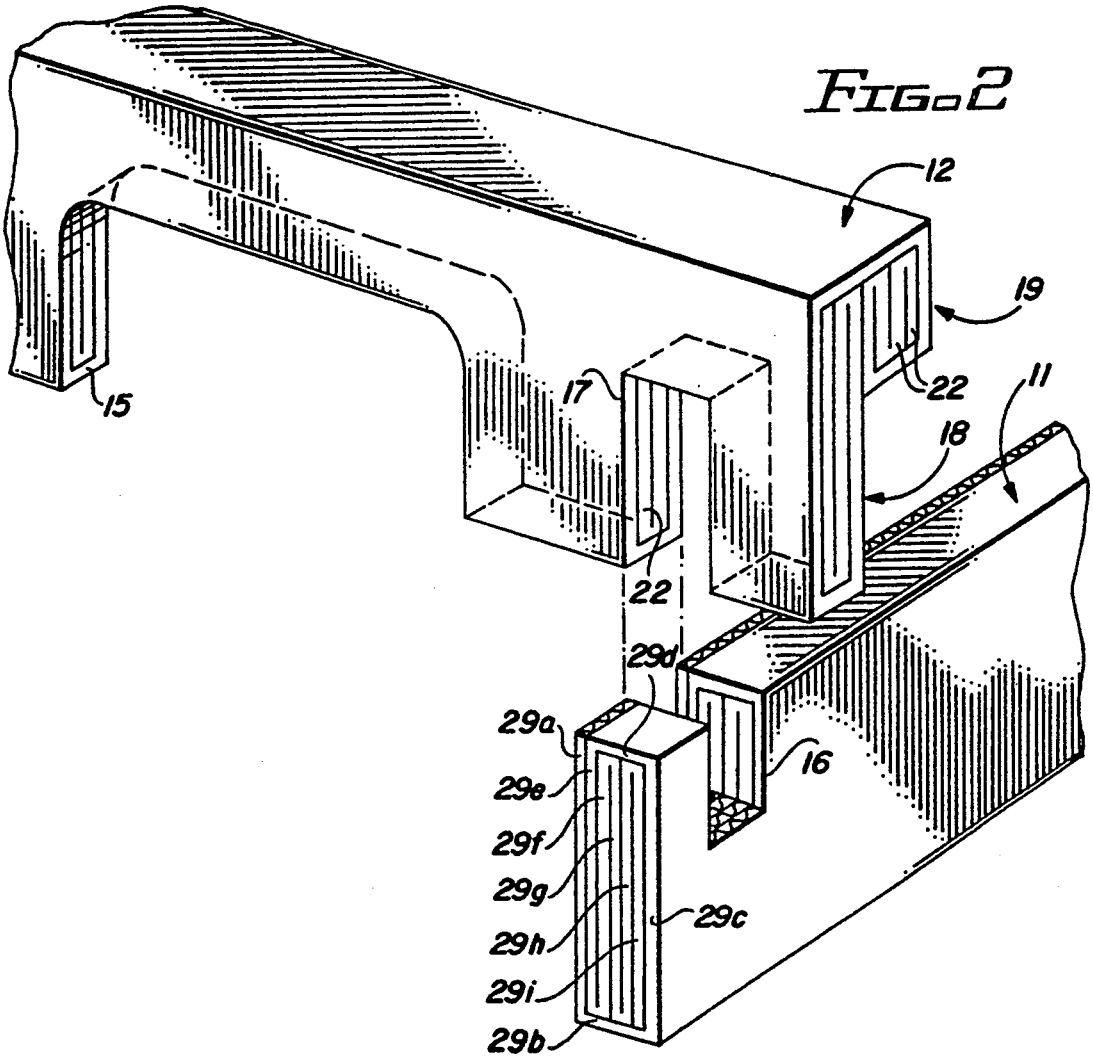
FIG. 2 is an enlarged fragmentary perspective view of a base member and a deck member of the pallet of FIG. 1, showing their manner of interlocking.

A preferred means of interconnecting members 11 and 12 is shown in FIG. 2. Members 11 are provided with upwardly-facing U-shaped rectangular notches 16 having spaced vertical walls ascending from opposite edges of an interior horizontal wall. Members 12 are provided with similar downwardly-facing U-shaped notches 17. The notches 16 and 17 are oriented perpendicularly to the elongation of the respective members 11 and 12, with the width (distance between opposite walls) of notches 16 being slightly less than the width (dimension perpendicular to the elongation) of the opposing member 12, and the width of notches 17 being slightly less than the width of the opposing member 11. To provide the level top and bottom surfaces, the vertical dimensions of the longitudinal members 11 and lateral members 12 are made equal, and the depths (vertical dimensions) of the cuts 16 and 17 are selected so that the interior horizontal will of the notch 17 is at the same elevation as the top (lifting) surface of the cutout 15 and sum of the depths of the notches 16 and 17 is equal to the vertical dimension of each member 11, 12.

Figure 4:
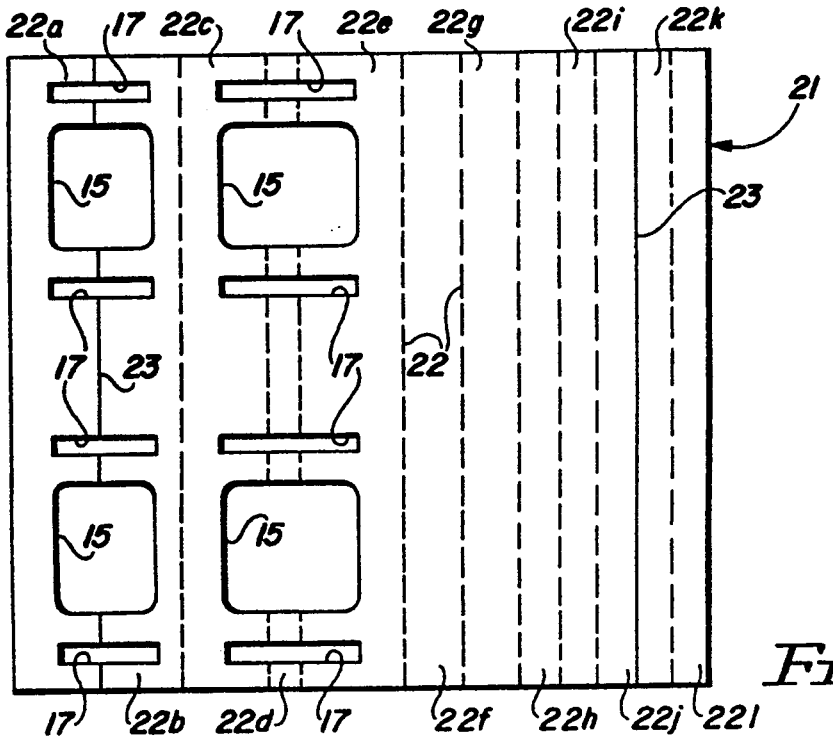
FIG. 4 is a front plan view of a blank suitable for forming the deck member of FIGS. 1–3.

As shown in FIGS. 2–4, each of the deck members 12 has a first rectangular cross-section portion 18 extending the full height (vertical dimension) of the pallet 10 and a second rectangular portion 19 flush with the top of the pallet 10 but extending only partway to floor level. The rectangular cutouts 15 and notches 17 extend only through the first portion 18 of the member 12 from floor level to a height which is flush with the bottom of an unbroken bottom panel of the second portion 19. This arrangement is best seen in FIG. 3 which shows the underside of the member 12. The purpose of such configuration is to provide an unbroken surface 20 on the portion 19 against which tines passing through the cutouts 15 can be brought. A portion of the horizontal wall of the notches 16 which is brought up through the notches 17 will also abut the surface 20. It has been observed that this unbroken surface backup feature greatly reduces breakage, such as the diagonal tearing at the inside corners of cutouts 15 that can occur when the pallet 10 is subjected to tine lifting under heavy loading. The same also resists ripping and distortion of the panel 10 in the are of the cutouts 15 when strapping is run therethrough for bundling goods on the pallet 10.

FIG. 4 shows a sheet or blank 21 or corrugated material suitable for use in forming the deck members 12 of the pallet 10. The blank 21 is arranged with the corrugations running from left to right perpendicular to the right- and left-hand edges of the sheet. The blank 21 is divided into adjacent parallel rectangular panels 22 (**22*a*–221), as shown, by crease lines 23 (dashed lines) and score lines 24 (solid lines) normal to the direction of corrugation. The crease and score lines may be created by die cutting or sawing partway through the material, with crease and score line cuts being done on opposite faces of the blank 21. To create the member 12, the blank 21 is folded, bringing adjacent panel front faces toward each other about crease lines 23 and taking them away from each other about score lines 24. The cutouts 15 and 17 are made as by die cuts in panels 22*a*–22*e*, as shown, to be properly positioned in the folded member 12**.

The panels **22*a*–22*e* of portion 18 and 22*g*–221 of portion 19 are separately folded onto the panel 22*f*, so that the end panels 22*a* and 221 are each interiorly placed in the core sections of their respective portions 18 and 19 in the finished structure. The fixed relationship of the panels is secured in known ways, such as by gluing or stapling. The finished member 12 comprises a closely packed core of adjacent vertically stacked panels 22*a*–*b*, 22*c* (upper portion) and 22*i*–221 surrounded by an outer covering or wrap of perimetrically placed panels 22*c* (lower portion), 22*d*, 22*e*, 22*f*, 22*g* and 22*h*. Panels 22*a*–*c*, 22*e*, 22*g*, and 22*i*–221 all have their corrugations oriented in the vertical direction to provide the greatest downward load bearing strength to the assembled pallet 10. Only panels 22*d*, 22*f* and 22*h* are horizontally oriented, and only one of those panels (i.e., panel 22*d* which serves as the floor contacting bottom surface) is cut to establish the tine cutouts 15 and the joint notches 17. (Though the preferred cutouts 15 are open to the floor because the tines are often lowered to scrape along the floor prior to lifting, it will be appreciated that cutting of the panel 22*d* at the locations of cutouts 15 is not a requirement.) For the vertical panels, transverse cutting of the fluting occurs only in the panels 22*a*, 22*b*, 22*c* and 22*e*. The panels 22*g* and 22*f*–221 remain intact. The horizontal panel 22*h* provides the unbroken surface 20 to give integrity for backing up the lifting portions of the cutouts 15 and 17. The unbroken horizontal panel 22*f* provides the top surface or deck for stacking the goods. It is noted that horizontal surface 22*d* of each lateral member 12 will contact the floor providing vertical weight support to the deck at all locations, except the cutouts 15 and notches 17**.

Figure 5:
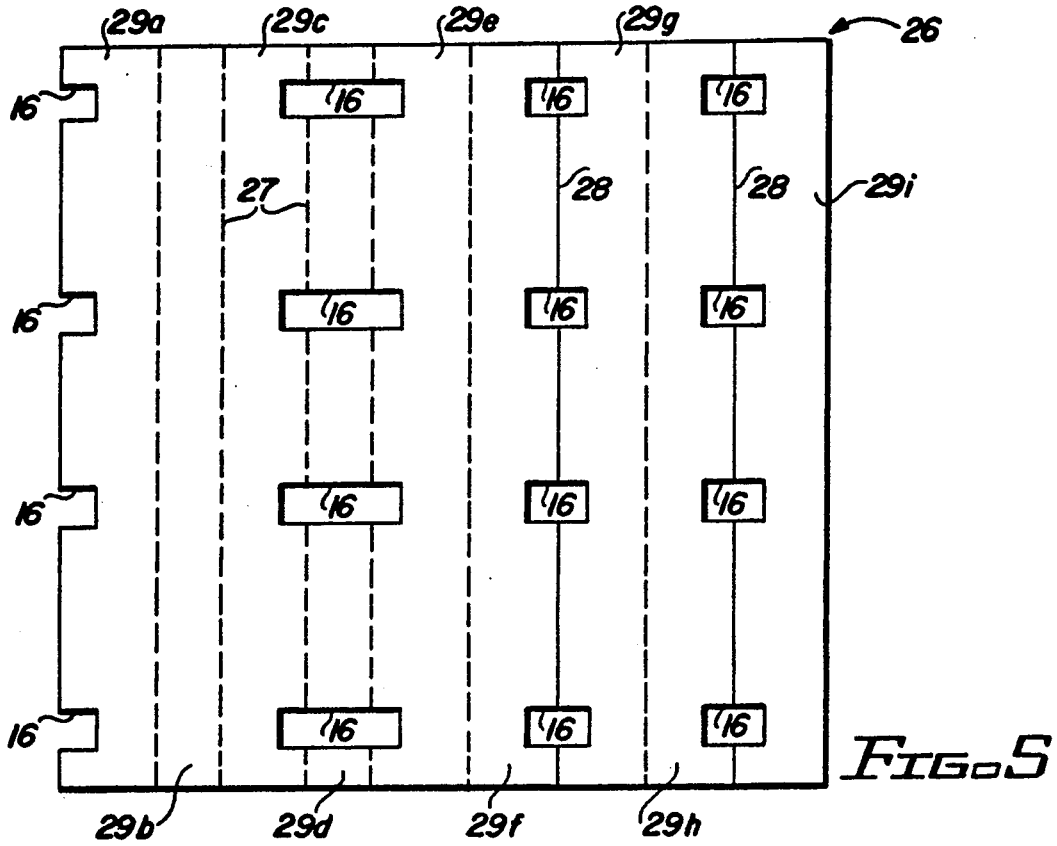
FIG. 5 is a front plan view of a blank suitable for forming the base member of FIGS. 1–3.

The base member 11 is suitably formed from a planar blank by folding similar to that described above for folding the blank 21 to create member 12, except there are no fork tine cutouts. With reference to FIG. 5, a rectangular blank 26 for member 11 has corrugations running from left to right, parallel with the upper and lower edges of the blank, but perpendicular to crease and score lines 27, 28 shown, respectively, by dashed and solid lines, which divide the blank 26 into adjacent rectangular panels 29 (**29*a*–29*i*). Cutouts 16 are die cut or otherwise formed in the blank 26, as indicated, to provide their proper location in the folded member. Folding is begun from the panel 29*i* end, bringing adjacent panels faces toward each other at crease lines 27 and away from each other at score lines 28. The finished folded structure 11 (see FIG. 2) has a closely packed core of adjacent vertically stacked panels 29*e*–29*i* wrapped by an outer covering of perimetrically placed, alternating vertically and horizontally disposed panels 28*a*–29*d*. All panels 29, except panels 29*b* and 29*d***, have their corrugations oriented in the vertical direction for greatest weight-supporting capacity.

The illustrated creasing and scoring arrangement enables the longitudinally extending, exposed fluting right edge of the right end panel **29*i* to be located interiorly of the folded member 11. Except for the upper and lower edges of the blank 26 which form the end of the elongated member 11 in the folded structure, exposed fluting thus occurs only at the left edge of the left end panel 29*a* and the cutout portions of the panels 29*a*, 29*c*–29*i* which form the notches 16**.

In the assembled pallet 10, all exposed fluting of member 11 is concealed, except the left edge of panel **29*a*. For the member 12, all exposed fluting, except at cutouts 15, will be concealed. The dimensioning of the notches 16, 17 of the members 11 and 12 provides a tight interlock between the members 11 and 12** which can be performed onsite, just before pallet use, and reinforced by gluing or other common joint securing techniques.

The embodiment 10 of pallet shown in FIGS. 1–5 constitutes a two-way entry version of corrugated pallet with the aligned cutouts 15 on the member 12 providing a pair of parallel channels extending longitudinally through the pallet and providing both front and rear access to apply forklift tines for lifting the loaded pallet. The unbroken horizontal panels **22*h* of the members 12 provide integral lifting surfaces 20 flush with the horizontally disposed interior wall of the cutouts 15 against which the tines act during lifting. These surfaces back up the exposed fluting parts of the cutouts 15 to increase the resistance of the pallet 10** to breakage and tearing by the tines.

Figures 6, 7:
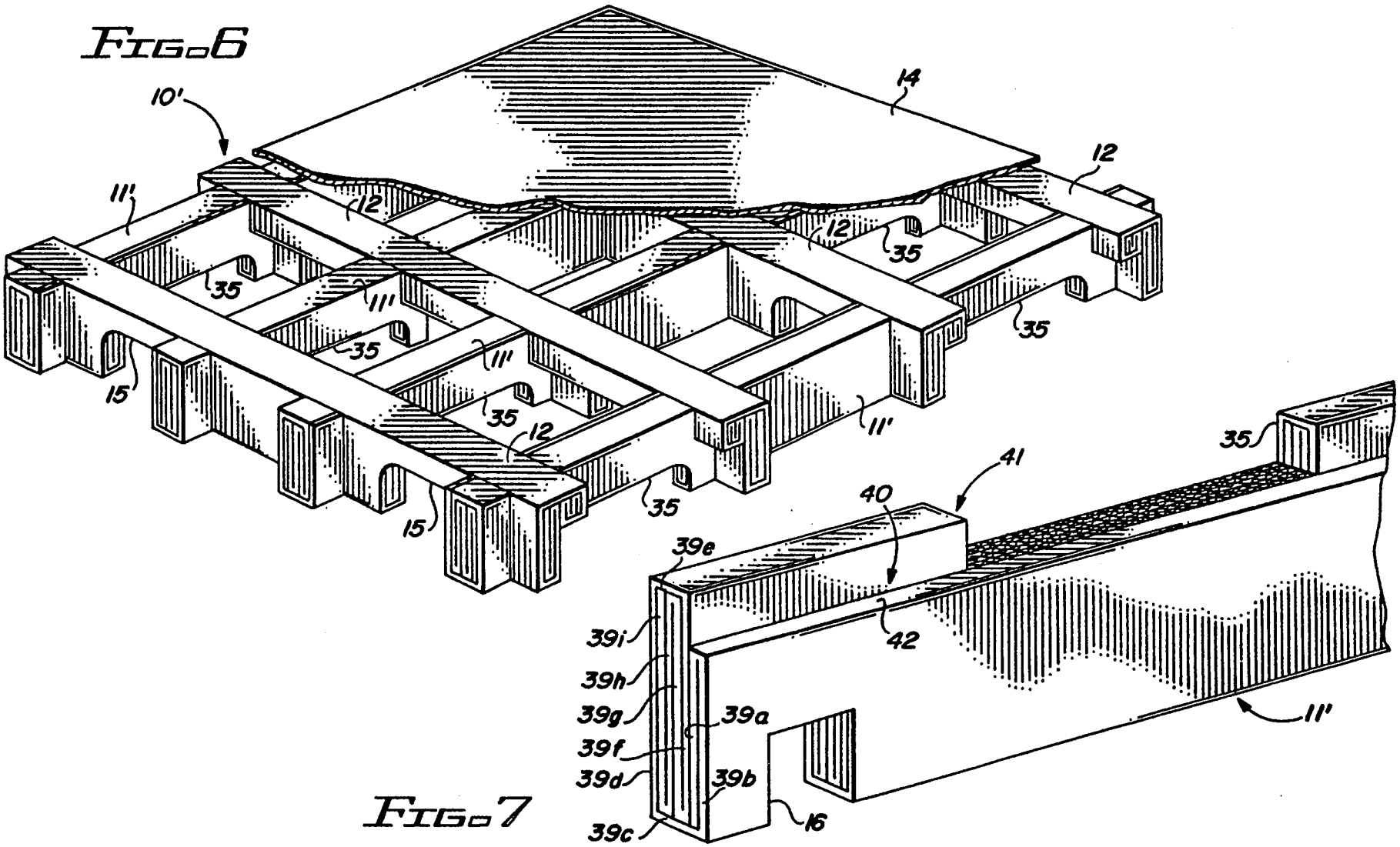
FIG. 6 is a view as in FIG. 1 of a modified form of the embodiment of FIG. 1.
FIG. 7 is a perspective view showing the underside of a base member of the modified structure of FIG. 6.

A modified form 10′ of the embodiment 10 of the pallet in accordance with the invention is shown in FIG. 6. Pallet 10′ has a modified base member 11′ which gives the pallet a four-way tine access capability.

Figure 8:
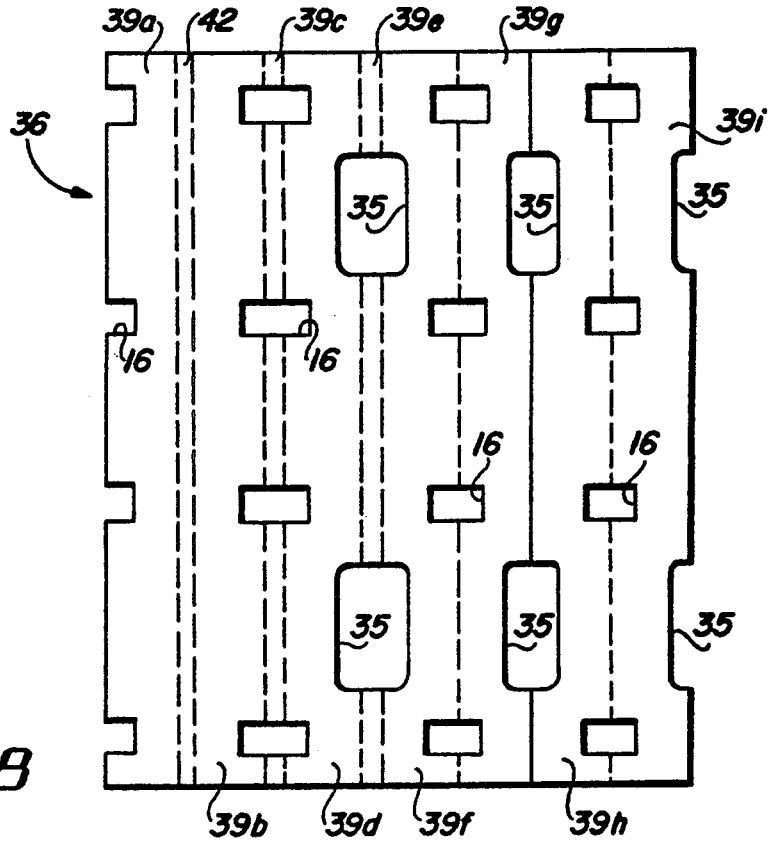
FIG. 8 is a front plan view of a blank suitable for forming the base member of FIGS. 6 and 7.

FIGS. 7 and 8 are views showing the particulars of the construction of modified base member 11′. It will be seen that the longitudinal member 12′ is constructed in a two portion manner similar to the already described construction of base member 11 shown in FIGS. 3 and 4. A rectangular blank of corrugated material 36 (FIG. 8) having corrugations running from left to right is divided by creasing and scoring lines 37, 38 (as with the previously discussed blanks 21 and 26) into adjacent parallel rectangular panels 39 (**39*a*–39*i*) which are folded toward each other on crease lines and away from each other on score lines to produce the folded and glued structure shown in FIG. 7**.

In contrast to the base member 11 of FIGS. 1, 2 and 5, the base member 11′ is provided with a series of cutouts 35 to form laterally aligned tine receiving openings in the lattice of pallet 10′, as shown in FIG. 6. Panels 39*a*-39*i* are folded along the indicated lines to produce a longitudinal member having adjacent rectangular portions 40, 41, with the portion 40 being formed from panels 39*a* and 39*b* and, like the portion 19 of member 12, being uninterrupted at the tine channel cutout 35. The blank 36 is separately folded either simultaneously or sequentially from the panel 39*a* end and the 39*j* end to produce the portion 40 from panels 39*a* and 39*b* and the portion 41 from the panels 39*d*-39*i*. Both the left and right exposed fluting edges of the blank 36 (i.e., the left edge of panel 39*a* and the right edge of panel 39*j*) are folded interiorly so that fluting is exposed only at the cutouts 35 and notches 17.

The panels 39*a*, 39*f* (upper portion), and 39*g*–39*i* make up the core of the member 11'; while the panels 39*b*-39*e* and 39*f* (lower portion) make up the outer wrap. All, except panels 39*c* and 39*e*, are vertically oriented with their corrugations running in the vertical direction for greatest strength. A rectangular section 42 intermediate a double fold line 37 between panels 39*a* and 39*b* provides an unbroken platform flush with the inside horizontal wall of the cutout 35 to provide backup support to the member 11' by increasing the integrity of the structure adjacent the tine-receiving slot in the same way that surface 20 provides a platform to cooperate with the tine-receiving cutout 15.

In the illustrated embodiment of pallet 10', the depth (vertical dimension) of the cutout 35 is less than the depth of the cutout 15. This is to maximize pallet access under normal conditions while minimizing the cutout areas on the longitudinal members. The cutouts 15 are made deeper to accommodate the higher floor-to-tine separation of heavy duty forklift equipment used at loading/unloading docks. Two-way, front/rear access will normally be sufficient for such high volume, fully-loaded pallet moving chores. The cutouts 35 are, however, sufficiently deep to provide four-way access to accommodate the lower elevation tines of less rugged, pneumatic tine lift trolleys that are frequently used to shift pallets around on a low volume, pallet-by-pallet basis during warehousing and for movement of inventory. The smaller depth of cutout 35 and lesser two-ply width of the unbroken section 42 (relative to the five-ply width of surface 20 of panel 22*h*) is considered sufficient for this purpose.

Pallets produced in accordance with the above embodiments have withstood testing in excess of 10,000 pounds under both static and dynamic loading. In one example test, a 4'×4' pallet of the two-way entry type shown in FIG. 1, was tested to determine its performance under load, under conditions simulating a cross country journey in a truck trailer. The tester had a table which had a 1" throw and a 1" drop. Based on the amount of load, the tester was set at a speed and ran for a given period of time to simulate a trip of some specified miles.

The tested pallet was constructed of dual arch, "a" width, normal double walled BC flute corrugated paperboard, without a top sheet. The pallet was tested for 50 minutes supporting 2,520 pounds at 180 RPM's. This simulated a trip of about 5,000 miles under most difficult road conditions, during which the pallet was exposed to fore, aft and sideways swaying motions. The pallet in accordance with the invention not only survived, but appeared to be like new—never used—at the end of the test. Only a wooden pallet with bottom slats could have survived the test as well. All known corrugated pallets would have fared very poorly or failed altogether under the same test.

In accordance with the invention, a superior strength pallet has been described by reference to preferred embodiments thereof, having particular advantages over corrugated pallets of the prior art, yet providing the same advantages of lighter weight and less cost than wood pallets. The stable configuration of the pallet allows for part of the pallet to experience damage without destroying the integrity and usability of the remaining portion. The pallet provides strong floor contacting, lateral weight-supporting members with minimal flute exposure, and structural reinforcement of all tine receiving openings.

Due to the unique design of the longitudinal and lateral members, a pallet in accordance with the invention can support a load while in a rack far in excess of conventional corrugated pallets. The design of the pallet provides for more supporting members to contact either the floor or the top of an underlying pallet load. This ensures greater weight distribution and, for stacked pallets, significantly reduces crushing or creasing of the load (in most instances boxes) of underlying pallets. Because the base and deck members support the load through contact with the floor in both the longitudinal and lateral members, the pallet in accordance with the invention can transverse most roller conveyor systems in any direction. Prior art pallets which have only longitudinal floor support are limited to movement in only one direction since the rollers must generally be oriented perpendicularly to the main supporting member in order to roll the pallet.

The pallet design provides for the ability of the pallet to absorb and withstand motion shock in all directions. By providing for interlocking members and having all supporting members contacting the floor, this pallet will not collapse because of any side motion pressure. Prior art pallets do not have this ability and are thus subject to failure when sued to transport loads by truck or rail over long distances. The four-way entry version provides four-way entry while maintaining superior strength and break resistance not available in similar prior art constructions. User different size and strength requirements can be met without the need to vary the overall design. Changes in dimensions, weight and type of corrugated material utilized, etc., will not interfere with the basic performance characteristics. This is not the case for prior art units.

Figure 9:
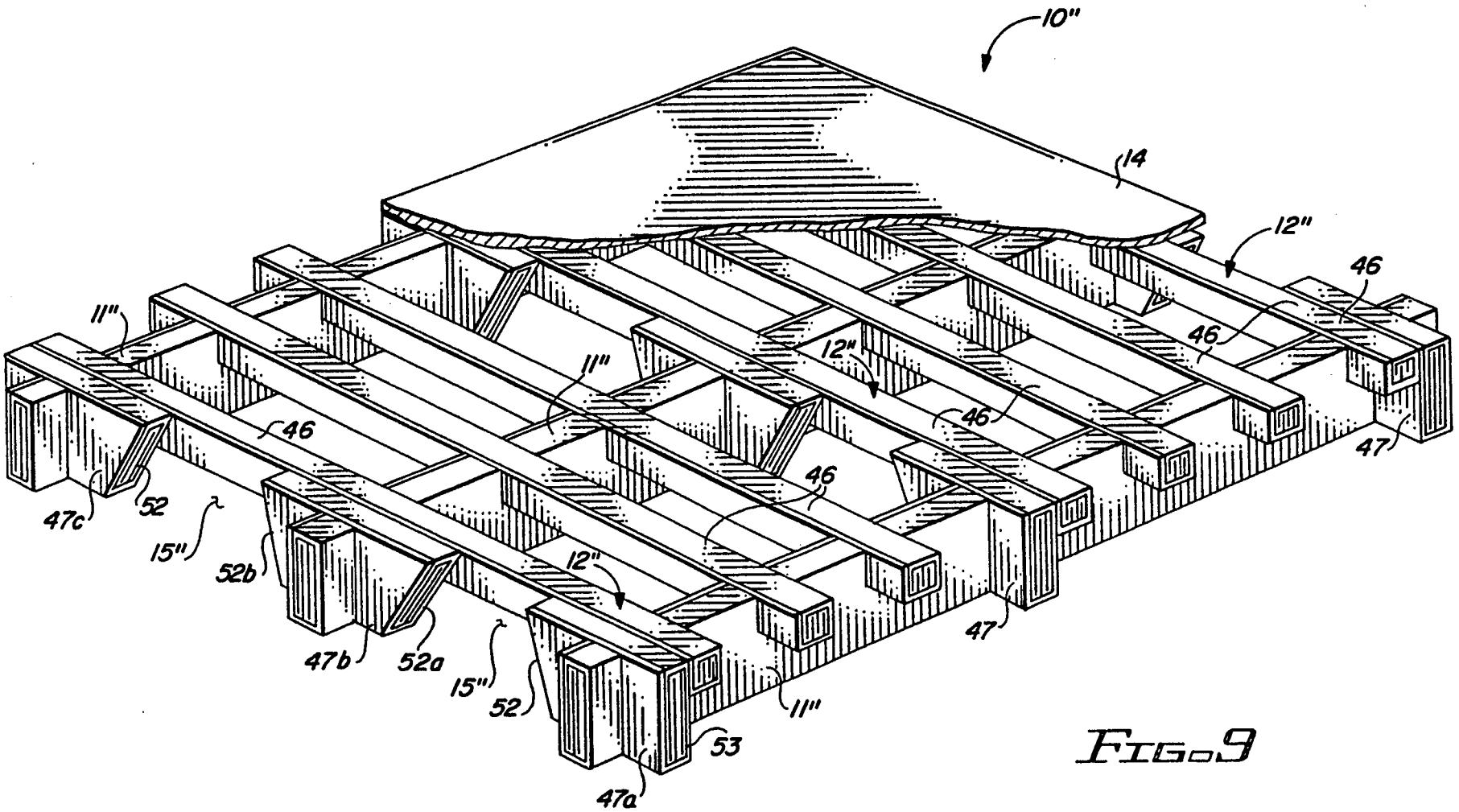
FIG. 9 is a view as in FIG. 1 of a further modified form of the embodiment of FIG. 1.

A further modified form 10" of the embodiment 10 of the pallet in accordance with the invention is shown in FIG. 9. Pallet 10" has base members or stringers 11", similar to base members 11 of pallet 10. The deck members or cross-stringers 12" of pallet 10" are, however, of two-piece construction, rather than of a single-piece construction like that of deck members 12.

Figure 10:
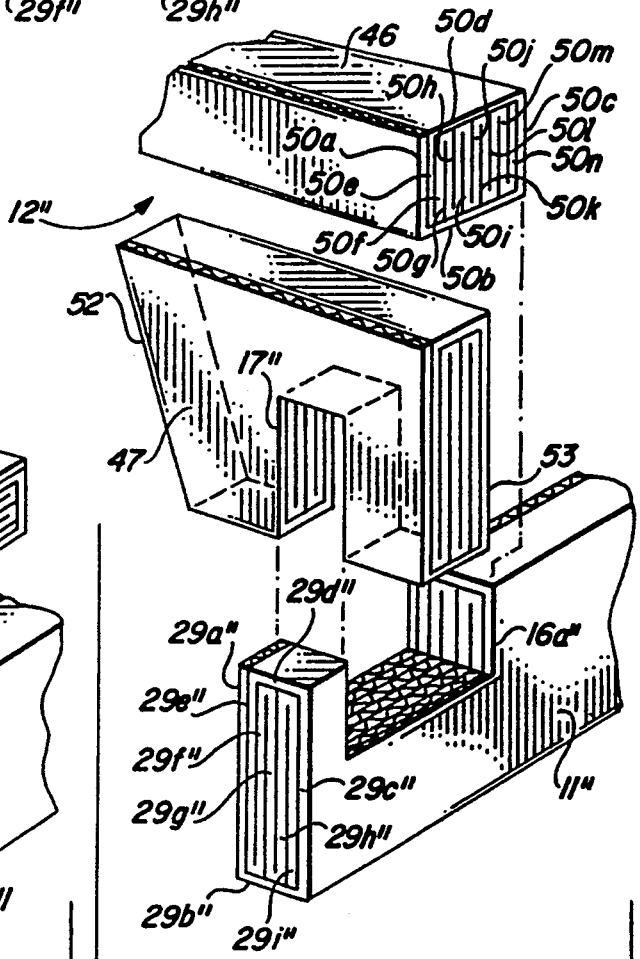
FIG. 10 is a view as in FIG. 2, showing the manner of interlocking of a base member, a deck member and a gusset of the further modified structure of FIG. 9.

As shown in FIG. 10, each deck member 12" comprises a laterally-extending, square cross-sectioned runner 46 (corresponding to the portion 19 of member 12) and a plurality of aligned, laterally-spaced gussets or braces 47 (corresponding to the portion 18 of member 12). The runners 46 are laid in parallel, spaced positions laterally of the pallet 10" to respectively perpendicularly intersect the members 11" at axially displaced positions therealong. The gussets 47 are positioned adjacent the runners 46 for reinforcement thereof, at the points of intersection of the runners 46 with the base members 11". The number of base members 11" and deck members 12" can be varied to suit individual requirements. The shown embodiment 10'' utilizes three base members 11'' and three combination decking members 12''. Additional runners 46, without gussets 47, can be added between the combination members 12'' as shown, for added stability and to fill out the common plane of the upper platform. The upper deck of pallet 10'' may be covered by an optional top sheet or deck 14, described above.

Figure 12:
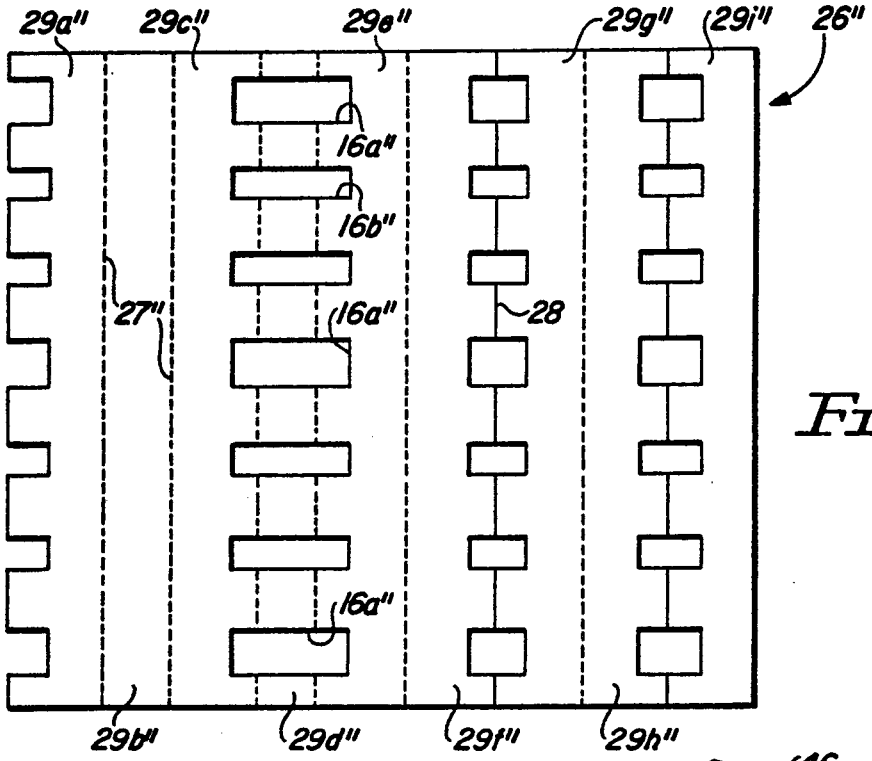
FIG. 12 is a front plan view of a blank suitable for forming the base member of FIGS. 9 and 10.
Figure 14:
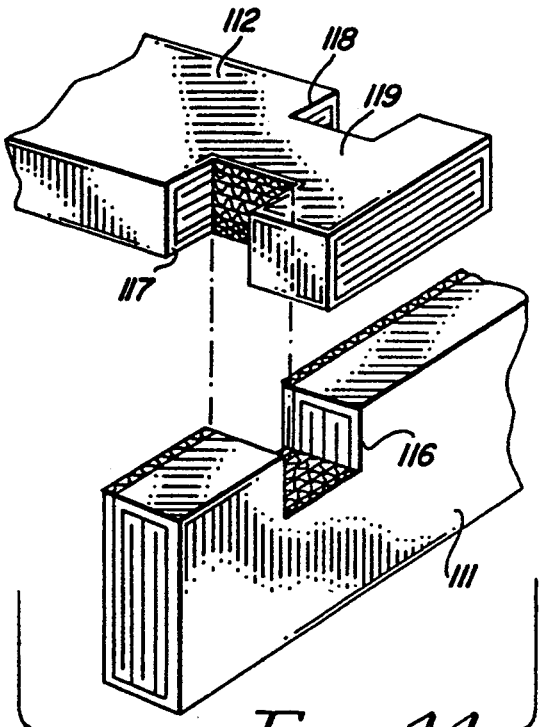
FIG. 14 is a view as in FIG. 2, showing the manner of interlocking of a base member and a deck member of the pallet of FIG. 13.
Figure 11:
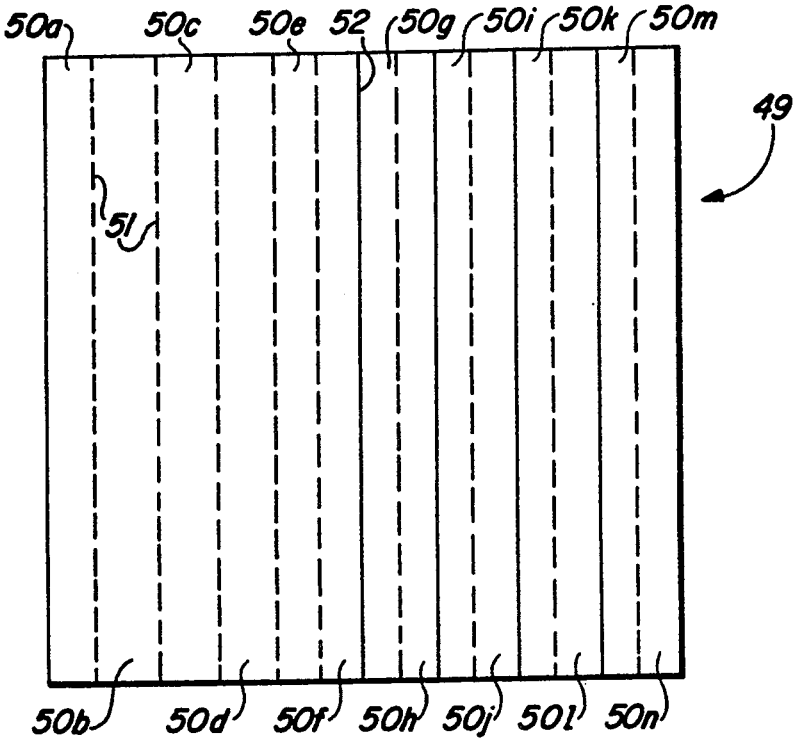
FIG. 11 is a front plan view of a blank suitable for forming the deck member of FIGS. 9 and 10.

The runners 46 may be formed from a sheet or blank 49 (FIG. 11), in the same way that the portion 19 of member 12 is formed from blank 21 (FIG. 4). The blank 49 is arranged with corrugations running from left to right, and is divided into adjacent parallel rectangular panels 50 (50*a*–50*n*), as shown, by fold lines 51 (dashed lines) and score lines 52 (solid lines) which extend normal to the direction of the corrugations. The base members 11'' may be formed from a blank 26'' (FIG. 12) similar to the blank 26 (FIG. 5) used to form the deck members 11. The blank 26'' is arranged with corrugations running from left to right, and is divided into adjacent parallel rectangular panels 29'' (29*a*''–29*i*''), as shown, by crease lines 27'' (dashed lines) and score lines 28'' (solid lines). Cutouts 16'' are die cut or otherwise formed in the blank 26'', as indicated. The cutouts 16a'' correspond to the cutouts 16 in the blank 26 (FIG. 5), and form the notches 16'' of the folded member 11'' (FIG. 10) into which the combination deck members 12'' are fitted. The cutouts 16*b*'' form the intermediate notches between the notches 16*a*'', into which the singular runners 46 are fitted.

The illustrated base members 11'' have the same general cross-sectional configuration and folding pattern as the members 11. The finished folded structure 11'' has a closely packed core of adjacent vertically stacked panels 29*e*''–29*i*'' wrapped by an outer covering of perimetrically placed, alternating vertically and horizontally disposed panels 29*a*''–29*d*''. All panels 29'' except panels 29*b*'' and 29*d*'', have their corrugations oriented in the vertical direction for greatest weight-supporting capacity. Similarly, the finished folded structure 46 has a closely packed core of adjacent vertically stacked panels 50*e*–50*n* wrapped by an outer covering of perimetrically placed, alternating vertically and horizontally disposed panels 50*a*–50*d*. All panels 50, except panels 50*b* and 50*d*, have their corrugations oriented in the vertical direction.

The gussets 47 may be formed from blanks or cut from formed pieces of the base members 11''. The folded crosssectional configuration of the gussets 47 is the same as that of the deck members 11''. End gussets 47*a* and 47*c* are formed with one angled edge 52 and one vertical end edge 53. Intermediate gussets 47*b* are formed with oppositely directed, downwardly-converging angled edges 52*a*, 52*b*. The gussets 47 are provided with downwardly-facing U-shaped notches 17'' which are mated with the upwardly facing U-shaped notches 16*a*'' formed in the base members 11''. The vertical dimensions of members 11'' and gussets 47 are equal, and the cuts 16*a*'' and 17'' are made so that the sum of the depths (vertical dimensions) of the notches 16*a*'' and 17'' will be equal to the vertical dimension of the members 11'', 47. The height (vertical dimension) of the runners 46 is chosen to match the depths of the notches 16*a*'' and 16*b*'', so that the top surfaces of the runners 46 received within the notches 16*a*'' and 16*b*'' will ben in the same plane as the top surfaces of the base members 11''. The width (distance between opposite walls) of notches 16*a*'' is chosen to be slightly less than the sum of the widths (horizontal dimension perpendicular to their elongations) of the runners 46 and gussets 47. The width of the notches 16*b*'' is made slightly less than the width of the gussets 47. The dimensions and angling of the gussets 47 are chosen so that longitudinal channels 15'' will be provided between the floor and the undersurface of the gussets 47 which are of approximately the same configuration as the channels 15 of pallet 10 (FIG. 1). The gussets 47 provide the floor contacting, weight supporting function of the portions 18 of members 12 of pallet 10; the runners 46 provide the lateral and diagonal stabilizing function of the portions 19 of member 12. The unbroken undersurfaces of runners 46 presented by the horizontally extending panels 50*b* (see FIG. 10), provide an unbroken surface backup to the channels 15''.

Figure 13:
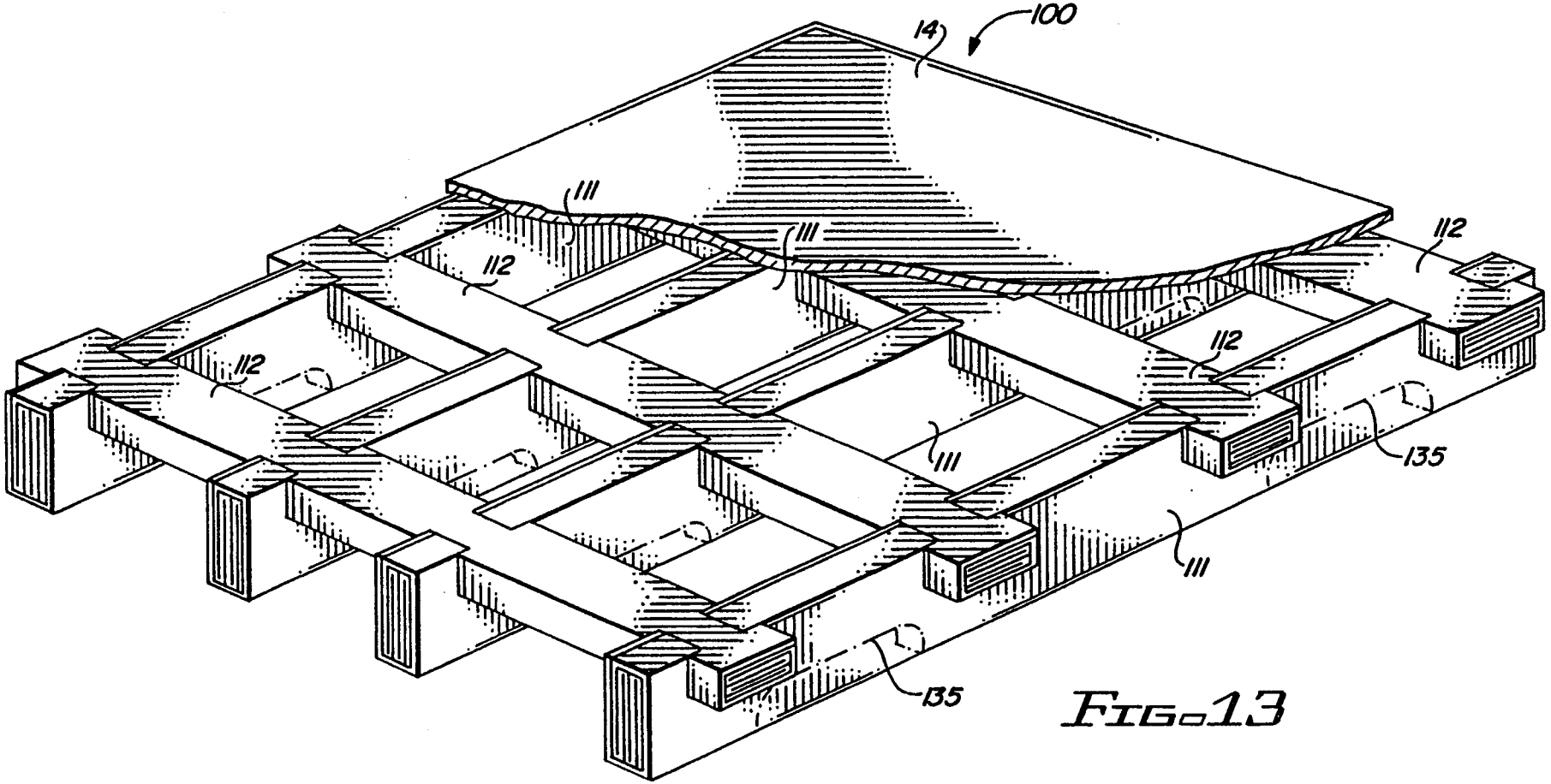
FIG. 13 is a view as in FIG. 1 of a second embodiment of corrugated pallet in accordance with the invention.

Another embodiment 100 of a pallet in accordance with the present invention is shown in FIG. 13. The pallet 100 comprises a plurality of base members or stringers 111 laid in parallel, spaced positions longitudinally of the pallet 110 and interconnected in criss-cross fashion by a plurality of elongated deck members or cross stringers 112 laid in parallel, spaced positions laterally of the pallet 110, to respectively perpendicularly intersect the members 11 at axially displaced positions therealong. The shown embodiment 110 utilizes four base members 111 and four decking members 112; though, of course, those numbers may be varied.

Pallet 110 represents an inexpensive, skid embodiment of the previously described pallet. The deck members 111 are constructed of corrugated cardboard, as already described above in connection with pallets 10, 10' and 10''. Each member 11 may be formed from a blank, like blank 26 shown in FIG. 5, to provide a folded structure having a closely packed inner core of adjacent vertically stacked panels wrapped by an outer covering of perimetrically placed, alternating vertically and horizontally disposed panels, with the vertically stacked panels all having their corrugations oriented in the vertical direction. Upwardly-facing U-shaped notches 116, of width slightly less than the width of the member 111, may be formed either by die cutting of the blank 26 prior to folding and gluing, or by cutting the notches 116 into the already folded structure 111. If desired, the members 111 may be provided with optional tine channel cutouts 135 (shown in dot-dashed lines in FIG. 13), like the cutouts 35 already described, for the purpose of providing four-way fork tine access.

The deck members 112 may be inexpensively provided by utilizing folded members of the same cross-sectional configuration as used for members 111, except that the same are placed in horizontal, rather than vertical, orientation. The folded and glued packed structure of member 111 should provide sufficient support in the horizontal position for skid utilization purposes, even without vertical corrugation orientation or the additional ground support provided by the deck members 12, 12'' of the described pallets 10, 10' and 10''. Where more ruggedized construction is desired, a separate blank can be employed to produce a member 112 whose inner core panels are vertically stacked, with vertically oriented corrugations.

Figure 15:
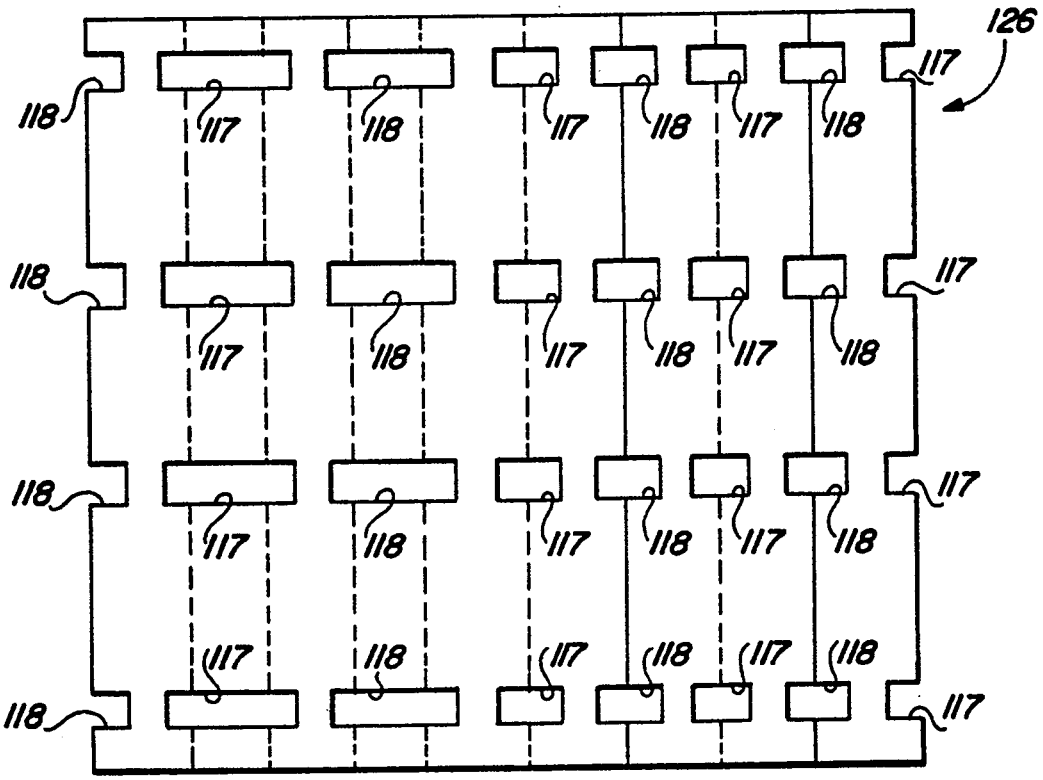
FIG 15 is a front plan view of a blank suitable for forming the deck member of FIGS. 13 and 14.

The members 112 have opposite horizontally outwardfacing U-shaped notches 117, 118 which may be die cut prior to folding, or cut out after folding. A suitable die cut blank 126 for forming deck members 112 is shown in FIG. 15. The blank 126 may be similar to the blank 26 usable to form the base members 111, with the die cuts for forming the notches 118 corresponding to those used for forming the notches 116; however, with additional die cuts added to form the opposing notches 117. Dimensioning may be chosen between the members 111 and 112 so that commonality of manufacture of those members can be maximized. For example, the notches 116, 118 can be identically configured, with the only difference between the members 111, 112 being the additional notches 117 which can be added prior to folding or cut into already assembled members 112. The minimum horizontal extent (distance between the bases of notches 117, 118) of members 112 is selected to be slightly greater than the length (dimension in the direction of elongation of member 111) of the notches 116, to apply a force fit of the reduced portion 119 of member 112 into the notch 116. The depth (vertical dimension) of notch 116 is chosen to match the width (vertical dimension) of member 112, so that the top surfaces of members 111, 112 of the assembled structure will lie in a common plane which can be covered by a top sheet 14, as with the other pallets.

Those skilled in the art to which the invention relates will appreciate that the foregoing detailed embodiments serve merely to illustrate exemplary implementations of the invention and that various substitutions and modifications may be made to the same, without departing from the spirit and scope of the present invention as defined by the claims appended hereto.

What is claimed is:

1. A pallet of corrugated material for the shipment and storage of a load of goods stacked thereon, comprising:

a) a plurality of elongated base members laid longitudinally in parallel, spaced positions; and b) a plurality of elongated deck members laid laterally in parallel, spaced, positions and intersecting said base members at longitudinally displaced positions therealong to interconnect the same to form a free standing lattice structure;

said base and deck members each having top surfaces located in a common upper horizontal plane to provide a level upper platform, and bottom surfaces located in a common lower horizontal plane to provide a stable, floor-contacting base; wherein each of said base and deck members comprises a solid core of adjacent vertically oriented panels surrounded by an outer covering of parametric horizontal and vertically running panels wherein at least one of said plurality of deck members has cutouts therein to present channels perpendicular to said base member into which tines of pallet lifting equipment can be inserted; and each of said base members being formed with first and second portions, said cutouts being in said first portions and defining lifting surfaces against which the tines inserted in said channels can act to lift said pallet, and said second portions being located adjacent to said first portions and defining backup surfaces of uncut corrugated material in alignment with said cutout lifting surfaces against which said tines can also act when they act against the cutout lifting surfaces during lifting of the pallet.

2. The pallet defined in claim 1, wherein at least one of said plurality of base members is provided with a series of cutouts to form laterally aligned tine receiving openings.

3. The pallet defined in claim 2, and including a top sheet attached to said pallet.

4. The pallet defined in claim 2, wherein said one of said plurality of base members is provided with a horizontally extending rectangular section to define a backup surface of uncut corrugated material located adjacent to said series of cutouts and defining backup surfaces of uncut corrugated material.

5. The pallet defined in claim 2, wherein each said base member having said laterally aligned tine receiving openings also has a first and second portion, said laterally aligned tine receiving openings being formed in said first portions and defining lifting surfaces against which the tines inserted in said channels can act to lift said pallet; and said second portions being located adjacent to said first portions and defining backup surfaces of uncut corrugated material in alignment with said laterally aligned tine receiving openings against which said tines can also act when they act against the cutout lifting surfaces during lifting of said pallet.

6. The pallet defined in claim 5, and including a top sheet attached to said pallet.

7. The pallet defined in claim 5, wherein the laterally aligned tine receiving openings of said base member are of a smaller depth than said cutouts of said deck members, and said second .portion of said base member is of a smaller width than the second portion of said deck member.

8. The pallet defined in claim 7, and including a top sheet attached to said pallet.

9. The pallet defined in claim 1, wherein said deck members are square cross-sectioned runners, and the bottom surfaces of said deck members and said base members are no longer in a common lower horizontal plane.

10. The pallet defined in claim 9, and including a top sheet attached to said pallet.

11. The pallet defined in claim 1, wherein at least some of said deck members are combination decking members of a multiple piece construction including a square cross-sectioned runner and a plurality of aligned, laterally spaced gussets, the bottom surfaces of said gussets being in a common horizontal plane with the bottom surfaces of said deck members.

12. The pallet defined in claim 11, and including a top sheet attached to said pallet.

13. The pallet defined in claim 1, wherein each of said elongated base members includes a plurality of upwardly facing U-shaped rectangular notches, and each of said deck members include a plurality of opposite, horizontally outward facing, U-shaped notches for engagement with said upwardly facing U-shaped rectangular notches, the upwardly facing U-shaped rectangular notches of said base members being in a mating engagement with said plurality of opposite horizontally outward facing U-shaped notches to form a weight supporting lattice structure wherein said base members and said deck members form a common upper horizontal plane no provide a level upper platform, the bottom surface of the base members and deck members no longer forming a common lower horizontal plane.

14. The pallet defined in claim 13, and including a top sheet attached to said pallet.

15. The pallet defined in claim 1, and including a top sheet attached to said pallet.

16. The pallet defined in claim 1, and including a top sheet attached to said pallet.

* * * * *

UNITED STATES PATENT AND TRADEMARK OFFICE

CERTIFICATE OF CORRECTION

PATENT NO. : 5,357,875

DATED : October 25, 1994

INVENTOR(S) : Ken N. Winebarger, Stanley M. Lee

It is certified that error appears in the above-identified patent and that said Letters Patent is hereby corrected as shown below:

Column 4, line 54, delete "will" and insert --wall--.

Column 5, lines 19, 31, 39, 42 and 55, delete "221" and insert --22ℓ--.

Column 12, line 57, delete "no" and insert --to--.

Signed and Sealed this

Fourth Day of July, 1995

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,357,875

DATED : October 25, 1994

INVENTOR(S) : Ken N. Winebarger, Stanley M. Lee

It is certified that error appears in the above-indentified patent and that said Letters Patent is hereby corrected as shown below:

Column 11, line 50, delete "base" and insert --deck--;
line 51, delete "base" and insert --deck--.

Signed and Sealed this

Ninth Day of April, 1996

*Attest:*

*Attesting Officer*

BRUCE LEHMAN

*Commissioner of Patents and Trademarks*